United States Patent [19]

Oerlemans et al.

[11] Patent Number: 4,976,845

[45] Date of Patent: Dec. 11, 1990

[54] PROCESS FOR INCREASING MESO PHASE CONTENTS IN PITCH

[76] Inventors: Peter Oerlemans, Wildzang 26, 6852 JP Huissen, Netherlands; Rolf Marrett, Eichenweg 17, 4620 Castrop-Rauxel, Fed. Rep. of Germany; Armin Eckert, Hachhausener Str. 53, 4354 Datteln, Fed. Rep. of Germany; Klaus Altfeld, Helstr. 3, 4630 Bochum, Fed. Rep. of Germany

[21] Appl. No.: 403,144

[22] Filed: Sep. 1, 1989

[30] Foreign Application Priority Data

Sep. 3, 1988 [DE] Fed. Rep. of Germany ..... 3829986
Jun. 8, 1989 [DE] Fed. Rep. of Germany ..... 3918705

[51] Int. Cl.[5] ..... C10C 1/00

[52] U.S. Cl. ..... 208/39; 208/22; 208/41; 208/44; 208/360; 423/447.1; 423/447.4

[58] Field of Search ..... 208/360, 44, 39, 41, 208/22; 423/447.1, 447.4

[56] References Cited

U.S. PATENT DOCUMENTS

| | | | |
|---|---|---|---|
| 1,404,435 | 1/1922 | Gevers-Orban | 208/360 |
| 1,742,933 | 1/1930 | Pew, Jr. et al. | 208/360 |
| 1,794,542 | 3/1931 | Piron | 208/360 |
| 2,076,498 | 4/1937 | Farwell | 208/360 |
| 2,095,470 | 10/1937 | Foley | 208/360 |
| 2,732,332 | 1/1956 | Geller | 208/360 |
| 3,974,264 | 8/1976 | McHenry | 423/447.4 |
| 4,016,247 | 4/1977 | Otani et al. | 423/447.4 |
| 4,042,486 | 8/1977 | Asano et al. | 208/44 |
| 4,243,512 | 1/1981 | Seo | 208/39 |
| 4,259,171 | 3/1981 | Stadelhofer et al. | 208/45 |
| 4,271,006 | 6/1981 | Dickakian | 208/44 |
| 4,379,133 | 4/1983 | Zander et al. | 423/445 |
| 4,469,667 | 9/1984 | Uemura et al. | 208/22 |
| 4,470,960 | 9/1984 | Uemura et al. | 208/22 |
| 4,497,789 | 2/1985 | Sawran et al. | 208/22 |
| 4,551,225 | 11/1985 | Dickakian | 208/44 |
| 4,575,411 | 3/1986 | Uemura et al. | 208/44 |
| 4,608,150 | 8/1986 | Itoi et al. | 208/44 |
| 4,801,372 | 1/1989 | Tate et al. | 208/44 |

FOREIGN PATENT DOCUMENTS 2124246 2/1984 United Kingdom .

*Primary Examiner*—Helane E. Myers
*Attorney, Agent, or Firm*—Michael J. Striker

[57] ABSTRACT

A process for increasing the content of mesophase in a pitch includes using a high molecular aromatic fraction based on a material selected from the group consisting of coal tar, crude oil and their mixture in molten form, thermally treating the fraction in form of a thin, continously moving film, and removing volatile components by degassing during the thermal treatment. The process distinguishes in using a high molecular aromatic fraction which may contain mesophase, shaping the fraction continuously mechanically to a thin film with a layer of thickness of between substantially 0.007 and 2 cm, successively mechanically forcedly transporting the film with the use of shear forces through at least one homogenization zone and one degassing zone, performing a mechanical homogenization of the film in the homogenization zone, performing a removal of readily volatile components in the degassing zone, and maintaining the temperature of the film in the homogenization zone and in the degassing zone in the region of between 320° C. and 470° C.

31 Claims, No Drawings

PROCESS FOR INCREASING MESO PHASE CONTENTS IN PITCH

BACKGROUND OF THE INVENTION

The present invention relates to a process for increasing the contents of mesophase in a pitch. More particularly it relates to such a process in which a high molecular aromatic fraction based on coal tar and/or crude oil in molten form and in form of a thin, continuously moving film is thermally treated, and volatile components are removed during the thermal treatment by degassing.

The process of this type is known in the art. Such a process for treatment of heavy crude oil pitch is disclosed for example in the German document DE-OS No. 2,925,549.

Carbon fibers and filaments have a great importance, for example as reinforcing fibers in synthetic plastic materials. They can be produced for example from polyacrylnitrile fibers or from pitch precursor fibers.

Since in many applications of these carbon fibers high strength and modulus values are required, many researches have been conducted to increase these values. It was found that the strength and modulus value of the carbon fibers can be increased by suitable selection and pretreatment of the initial material. It has been known for a long time that the pitch fibers with a high contents of mesophase are very well suitable for subsequent treatment to carbon fibers with high strength and high Young-modulus. This subsequent treatment can be performed by known methods and generally includes a pre-oxidation, and subsequent carbonization and in some cases graphitization.

Pitch fibers with high mesophase contents are produced by melt spinning of a pitch which also has a high mesophase contents. Mesophase is interpreted as regions which contain the aggregation of oriented molecule units having flow condition. Since the reorientation is formed substantially in a predetermined direction, mesophase regions have optical anisotropy. For this reason the mesophase in pitch is identified also as anisotropic phase or as anisotropic region. The contents of a pitch as to mesophase can be determined for example by polarized light, for example with a polarization microscope. Also, the solubility properties of the pitch in certain solvents can be used for determining the contents of mesophase, since the mesophase generally is considerably less soluble than the non-oriented (isotropic) fractions of the pitch.

Since pitches of conventional type, for example those recovered in conventional processes from coal tar pitch or crude oil pitch are isotropic without preceeding thermal treatment, their contents as to mesophase must be increased by respective pre-treatment if pitch fibers with high mesophase contents must be produced by melt spinning. Processes were developed to increase the mesophase contents of a pitch. It was found that by a temperature treatment with inert gas, for example, in the region of between 250° and 500° C., the mesophase contents is increased, which can be traced back to chemical processes such as polymerization and physical processes such as evaporation of low molecular, readily volatile isotropic components.

When it is necessary with such known thermal processes as heating of the pitch in an open vessel, to convert isotropic solid-free pitches into pitches with high mesophase contents, for example, in pitch with 80–100% mesophase, many disadvantages and difficulties occur. On the one hand, such processes consume a lot of time, since the production of the mesophase and the volatilization of the low boiling components from the interior of the pitch runs very slow. Increase of the treatment temperature accelerates the production of the mesophase; however, the increased quantity of solid components, such as coke, which are not suitable for the melt spinning is formed at the increased temperature. Moreover, softening temperatures, flow temperatures, viscosity of the mesophase fraction increase with increasing treatment time and treatment temperature. For the melt spinning of mesophase pitch, very high flow temperatures and viscosities are however not desirable.

Attempts were made to increase the mesophase contents of pitch within shorter times. One possibility is described in U.S. Pat. No. 3,974,264. In the process disclosed in this reference an inert gas is supplied during the thermal treatment through the pitch for removing the readily voltatile components faster. The disadvantage of this process is that here also relatively long treatment times are needed, since it is performed in conventional vessels with high pitch volumes. In this process there is also the danger of multiplied coke formation and increased viscosity of the mesophase fractions, since the formed mesophase regions further polymerize when the conversion of isotrope regions into mesophase is performed.

An improved process is disclosed in the German document DE-OS No. 2,925,549. In this process the temperature treatment of the pitch is performed so that pitch in form of a laminar stream is introduced into a reduced pressure vessel, sinks there downwardly under the action of the gravity force, and removed from the bottom of the vessel. A temperature up to 300° C. is used in this process. The advantage of this process is that the pitch can be thermally treated as a thin film in a continuous fashion. Thereby volatile components can be removed faster than in the event of high pitch volumes during stationary treatment.

This process however possesses several disadvantages. First of all, the speed of the mesophase enrichment is relatively low because of the low treatment temperature. The low treatment temperature has a further disadvantage in that the increase of the contents of mesophase practically deals exclusively with removal of low molecular, readily volatile components, while no formation of mesophase because of polymerization occurs. The high molecular isotropic regions remain and are not converted to mesophase, so that pitch with very high mesophase contents cannot be produced in this process. Moreover, the pitch flows in form of a laminar stream without a mechanical homogenization. Since isotropic and mesophase fractions of the pitch are soluble in one another only to a limited extent, two phases of different viscosity can be produced in this process. Therefore a subsequent melt spinning is undersirably affected. Due to the fact that the mesophase has a higher specific weight than isotropic phase, it is also possible that during flowing of the pitch under the action of gravity force from above downwardly, differences in flow speed of the mesophase fraction relative to the isotropic fraction take place.

SUMMARY OF THE INVENTION

Accordingly, it is an object of the present invention to provide a process for increasing the contents of mesophase in a pitch, which avoids the disadvantages of the prior art.

More particularly, it is an object of the present invention to provide a process of the above-mentioned type, in which the contents of mesophase in a pitch based on coal tar or crude oil can be increased in a short time without using such high temperatures that in relatively short time high disturbing quantities of products which are difficult to melt (coke) are produced.

It is also an object of the present invention to provide a process of the above-mentioned type, in which the mesophase contents can be increased up to 100 weight percent, and a separation between isotropic phase and mesophase is prevented, so that the produced pitch which is enriched with mesophase can be continuously supplied to a melt spinning machine.

In keeping with these objects and with others which will become apparent hereinafter, one feature of the present invention resides, briefly stated, in a process for increasing the contents of mesophase in a pitch, in accordance with which a high molecular aromatic fraction which may contain mesophase is used, this fraction is continuously mechanically formed to a thin film with a layer thickness of substantially between 0.007 and 2 cm, and the film is mechanically forcedly transported with use of shear forces through at least one homogenization zone and at least one degassing zone. In the homorgenization zone or zones mechanical homogenization of the film, and in the degassing zone or zones the removal of readily volatile components are performed, with the temperature of the film in the homogenization zone or zones and in the degassing zone or zones, lying between 320° C. and 470° C.

The process in accordance with the present invention possesses the following advantages as compared with the process disclosed in the German reference DE-OS No. 2,925,549;

1. The temperature of the thermal treatment is higher, so that the enrichment of the mesophase is performed faster, and mesophase is formed from isotropic phase by chemical reactions.
2. Since a homogenization is performed before the removal of volatile components (degassing), the removal of the readily volatile components can be controlled easier and can be regulated in intended manner better. This is true to an even greater extent when several degassing zones are provided, located after each homogenization zone. Therefore it is possible to operate in the first degassing zone with a lower temperature and higher pressure than in the second or in further degassing zones. Since the pitch reaching the second degassing zone already has a lower content of volatile components than the initial pitch, a considerably lower pressure can be used here. Therefore, the removal of the residual volatile components is performed faster and more complete. In contrast, in the process disclosed in the German reference DE-OS No. 2,925,549 lower pressures of several mbar are not useable, since a sudden and uncontrolled evaporation of low boiling components would occur.
3. The homogenization performed before the degassing step or steps prevents a phase separation between isotropic and meso phase components and enables a fast controlled removal of low boiling components in respective subsequent degassing steps. The homogenization which leads to a uniform phase with controllable viscosity makes possible a continuous supply of the pitch enriched with mesophase to a melt spinning machine.
4. The homogenization and forced (positive) transportation of the thin pitch film prevents separation into two phases of different viscosity, which occurs in the process of the above mentioned German reference due to different flow speeds under the action of the gravity force.
5. The treatment temperature in a second and in some cases further degassing zone or zones can be increased relative to the first zone and selected considerably higher than in the case of the process of the German reference, since in this zone the content of readily volatile components is lower. In the process in accordance with the German reference in the event of use of temperatures substantially more than 300° C. the residence time of the pitch at high temperature must be considerably longer, since the contents of low boiling components is high and their removal takes time. The residence time of the formed mesophase at high temperature would therefore be too long to prevent formation of high viscous and coke-like products. In contrast, in the inventive process the residence time in the second degassing zone at high temperature can be maintained shorter, since in this zone smaller amounts of readily volatile products must be removed. This is supported by the fact that here it is possible to operate at very low pressures, for example at substantially $10^{-2}$ mbar. The result of the high temperature is a faster increase of the mesophase fraction, the result of the shorter residence time is a low viscous and thereby readily spinnable mesophase pitch, also for the case when the mesophase content amounts to 100%.
6. The utilization of shearing forces promotes the formation of mesophase by orientation of molecule units (aggregates). Moreover, the utilization of the shearing forces eliminates the following disadvantage of the process in accordance with the German reference DE-OS No. 2,925,549: With the pitch moving as a liminar film in the process of the German reference a relatively long residence time takes place and heat is supplied to the same pitch components on the overheated wall to the pitch film. Since no shear forces act on the film, this wall must be maintained at a temperature which is higher than the temperature desired average for the pitch. Only in this way can it be guaranteed that the surface of the pitch film remote from the wall can reach the desired minimum temperature. Due to the overheating of the wall, there is a danger that the pitch components flowing on the wall will have a tendency to coking. In contrast, in the process in accordance with the present invention the use of shear forces provides for a continuous mixing, so that longer residence times for the same pitch components on the wall are excluded. Moreover, the temperature distribution over the thickness of the pitch film is more uniform. Pronounced overheating of respective parts of the arrangement is not required.

The novel features which are considered as characteristic for the invention are set forth in particular in the appended claims. The invention itself, however, both as to its process and its method of operation, together with additional objects and advantages thereof, will be best understood from the following description of specific embodiments.

DESCRIPTION OF THE PREFERRRED EMBODIMENTS

For the process in accordance with the present invention a high molecular aromatic fraction based on coal tar and/or crude oil is used, while a mixture can be used as well. Such fractions are conventionally identified as pitches based on coal tar or crude oil. The term "pitch" will be used hereinbelow for identification of all initial substances. Isotropic pitch is produced from coal or crude oil in accordance with known methods. For example, by treatment at approximately 1,100° C., volatile components can be isolated from coal tar, condensed, and subsequently distilled at approximately 400° C. at reduced pressure. The residue is coal tar pitch. From crude oil, crude oil pitch can be produced also as residue of a distillation. These pitches which in normal condition are completely isotropic can be used in this form of the inventive process. Preferably they are however pretreated in a suitable manner so that they have a mesophase content of between 30 and 90 volume percent. It is especially advantageous when the used pitch already contains a mesophase contents of 70–90 percent. Then, during the thermal treatment of the thin film, for example in an extruder, a smaller quantity of volatile components must be removed than in the event of low contents of mesophase in the initial material. As a result, a very high mesophase content of for example up to 100 percent, can be obtained in relatively short time in fine manner.

Suitable pretreatment methods are known and include for example a filtration for removing components which are difficult to melt (coke) and/or other solid components, and a distillation as well as in some cases a thermal treatment for forming of mesophase for example in the region of between 300° and 350° C. and in some cases extraction with solvent. Also, a thermal treatment, subsequent filtration and then another thermal treatment can be performed. The so treated pitch before being used for the inventive process can be subjected to a further treatment, for example a separation and decanting process. In the latter case, a mechanical separation of two liquid phases which are not soluble in one another is performed. These steps result in a separation of a mesophase-rich phase from a mesophase-poor phase. The mesophase-poor phase can again be added to an isotropic pitch fraction for thermal treatment. The mesophase-rich phase is used for the inventive process. These separation methods are advantageous, since in the case of their use, the preceding thermal treatment can take a relatively short time and therefore less solid components and high viscous products are formed. The preceding thermal treatment can be short, since it suffices to produce only a relatively low content of mesophase. The enrichment is performed subsequently by the separation process. In some cases, after the separation process the mesophase-rich phase can be again filtrated and released from solvent.

The pitch which is used for the invention process has for example already a contents of 30 to 90 volume percent, especially 70–90 volume percent mesophase. The content of the mesophase is determined in the following manner:

Particles produced from solid, comminuted pitch with an average diameter 2–2.8 mm are embedded in Epofix (hardenable resin). The mass is hardened, and discs with a diameter and a thickness of each approximately 2.5 cm are made from the hardened material. They are rubbed with silicium carbide paper and then polished first with silicium carbide paper of 2,400 and then 4,000 mesh. A subsequent polishing is performed with diamond paste.

Photographic pictures of the polished probes are made by means of polarization microscope. Circular polarizaed light is used for obtaining an adequate contrast. The isotropic fractions or (in the event of phase inversion) the mesophase fractions are encircled on the photograph with a pencil. The surface fraction of the encircled fractions is measured by an optical measuring device, for example Context Vision Image Analyzer.

Ten photographs are made from each sample, and each shows a different part of the sample. A medium value for the surface fraction or volume fraction of the mesophase is computed. For pitch which is used as initial material for the inventive process, the magnification during photographing amounts to approximately to 280:1 for pitch which was treated in accordance with the process of the present invention the photographs with magnification of 2,500:1 are prepared. The values presented here are determined with the above mentioned methods.

With a mesophase content of more than 30 percent, the method is especially favorable due to the low content of isotropic and readily volatile components. Also with a mesophase content of the initial pitch of up to 90 percent the process is advantageous since due to the required quality of the pitch fibers or carbon fibers to be produced it can be desired to increase the contents further.

The high molecular aromatic fraction (pitch) used for the inventive process, which after pretreatment and cooling can be available in solid form, for example in the form of particles, or in molten form, is continuously processed with the inventive process. For the case where it is in solid form, it is first melted.

The molten pitch is mechanically shaped to a thin film with a layer thickness of approximately 0.007–2 cm. The film is then transported through at least one homogenization zone and at least one degassing zone. The film is transported by a mechanical forced transport, preferably in substantially horizontal direction. The advantage of the horizontal arrangement of the apparatus for the horizontal movement of the pitch film is that the degassing step in this case can be performed simpler. The apparatus in which these treatment steps are performed is arranged preferably horizontally or approximately horizontally.

Preferably, not only one homogenization and only one degassing zone are used, but one or several further homogenization and degassing zone or zones located in alternating order are used. In this case, the pitch film is also mechanically forcedly transported through these zones, preferably in a substantially horizontal direction. The use of more than one homogenization zone and degassing zone has the advantage that the pressure can be lowered and the temperature can be increased in a stepped manner from one zone to another, while in the first homogenization and degassing zone limits can be set by high contents of volatile components.

The forced transportation in a substantially horizontal direction prevents, together with the homogenization, a phase separation.

In the homogenization zone or zones, a homogenization of the film is performed by mechanical action. It is done for activating a thorough mixing (emulsification) of the mesophase and isotropic fractions with one another which generally are poorly soluble in one another. Whether the mesophase is emulsified in the isotropic phase or vice versa, depends on the quantity ratio of both phases relative to one another. By the homogenization, a phase separation is avoided and the uniform, fast and easily controllable removal of volatile components in the subsequent degassing zone or zones are obtained.

In the degassing zone or zones, readily volatile components are removed. Their boiling point at the acting pressure lies lower than the temperature in the degassing zones.

The removal of readily volatile or in other words low molecular isotropic fractions leads to an increase of the weight fraction of non-volatile mesophase. Moreover, the mesophase content can be increased by further polimerization and orientation of the molecules at the temperatures used in the homogenization and degassing zones. Since in normal situations it is necessary to avoid an oxidation of the pitch during the homogenization and degassing, the admission in this case of media acting with the pitch under oxidation is excluded. The homogenization zones are preferably closed from the environment so that in these zones no special steps must be taken to prevent oxidation. If, however, it is connected with the environment, the operation in the homogenization zone must be performed with inert gas. Volatile components must be removed and withdrawn in the degassing zones. It is advantageous to operate in the degassing zones with inert gas which is free of oxygen. For economical reasons, nitrogen can be used as inert gas; however, also noble gases can be used, for example argon or any other gas or gas mixture which does not react with pitch. It is advantageous when the inert gas is not stationarily applied to the pitch film, but moves in the degassing zone over the surface of the pitch film. This can be achieved by first supplying the inert gas at the beginning of the respective degassing zone and withdrawing the inert gas together with the evaporated volatile components at the end of the degassing zone. When the inert gas moves, it acts as traction or carrier gas and makes possible a fast withdrawal of volatile components produced from the pitch.

In the homogenization and degassing zone or zones the temperature of the pitch film lies in the region of 320°–470° C. With temperatures below 320° C. and above 470° C. the process can also be used in principle. However, since with lowering temperatures the increase of the contents of the mesophase takes longer and with very high temperatures the danger of the coking increases, the process is advantageously performed within the above temperature range. It is advantageous when the utilized apparatus is heated in a degassing zone to the same or higher temperature than in the preceding homogenization zone. In this manner the evaporation of volatile components can occur first of all in the degassing zones, in which these components can be withdrawn to the environment. It is advantageous when the pitch film in the homogenization zone or zones has a temperature in the region of 370°–470° C. and/or in the degassing zones also has temperatures in the region of 370°–470° C.

In the homogenization zone or zones a temperature can be used in the region of 320°–470° C., preferably 370°–470° C. It is advantageous to lower the temperature of the film after leaving the last degassing zone by cooling. Thereby the degassing is interrupted and the further evaporation of volatile components is eliminated. This is of advantage when the pitch after the last degassing step is supplied in a continuous process to a melt spinning machine. In this case the temperature provided for the spinning. The spinning process otherwise can be undesirable affected by gas formation in the pitch.

The molten pitch is mechanically shaped to a thin film and in this form is continuously mechanically forcedly transported and thermally treated. The shaping to a film can be performed for example by suitable stripping devices in the apparatus. The thus produced pitch film has a layer thickness in the region of approximately 0.007–2 cm. Thinner layer can encounter difficulties in the handling or further transportation, first of all since in the course of thermal treatment the layer thickness can be reduced because of evaporation of volatile components. With layer thicknesses higher than 2 cm the process can also be performed in principle. However, the advantage of a fast and careful increase in the mesophase content is of less value, since with increasing layer thicknesses the removal of volatile components takes more time and the formed mesophase during long residence times can further polymerize at high temperatures. Therefore, there is a danger that high viscous and coked products are produced. In a preferable embodiment of the process, the thickness of the molten pitch film lies in the region of 0.007–0.5 cm. It is especially advantageous when the layer thickness of the film in the homogenization zone or zones is greater than in the following degassing zone or zones. The thickness of the film is determined by the utilized apparatus can be adjusted for example by suitable adjustable stripping elements.

In accordance with an especially advantageous embodiment of the present invention, the homogenization zone or zones are closed from the environment in gas-tight manner, and no components are removed from the pitch in the homogenization zone or zones. In some cases, an increased pressure can be used for this purpose. This embodiment in which in the homogenization zone or zones also such components are not removed from pitch which at the present temperature and normal pressure are volatile, is especially advantageous since these components are then available for formation of mesophase. Especially anthracene and naphthaline which both appear in the coal tar pitch are well suitable for formation of mesophase because of condensation reactions at increased temperature. When these components are not removed, mesophase can be formed from them in the homogenization zone. The thus formed mesophase is then also no longer volatile in the following degassing zone. Thus, the above-mentioned preferable embodiment leads to an increase in the total yield of pitch enriched with mesophase. For insuring that the components which are volatile at the temperature of the homogenization zone and under normal pressure are not removed, the homogenization zone is closed from the environment in a gas-tight manner. It can be additionally required or be advantageous to operate with a certain pressure in the homogenization zone. This embodiment of the process in which in the homogenization zone or zones no components are removed can be performed so that it deals with all present homogenization zones or only with their part, for example only with the first homogenization zone.

It is especially advantageous to implement this preferable embodiment of the process in an extruder. In this case, the extruder is provided with openings in the degassing zone or zones for escaping of the volatile components, and the homogenization zone or zones are closed from the environment in a gas-tight manne.

Preferably the inventive process is preformed so that during the thermal treatment of the pitch film in the degassing zone or zones, a pressure in the region of $10^{-2}$ to 1,200 mbar is present.

It is advantageous especially when several degassing zones are provided if in the first degassing zone a not very low pressure is present, for example a pressure in the region of 100–1,200 mbar. Then in this zone the especially easily volatile components are removed. An excessively strong evacuation in this region can lead to the fact that also components with higher boiling points can be removed, and an excessively fast and uncontrolled evaporation can occur. The evaporation of the readily volatile components can be somewhat reduced when needed in the first degassing zone by applying a slight overpressure. Preferably the process is preformed so that in the first degassing zone a pressure in the region of 100–1,200 mbar is provided, and the remaining degassing zones a pressure in the region of $10^{-2}$–100 mbar is provided. In the second degassing zone, or in some cases even further degassing zones it is possible to reduce considerably the pressure since in the first degassing zone a significant part of the volatile products was removed. By gradual lowering of the pressure with advancing degassing steps, the degassing (evaporation) can be regulated in a controlled manner becasue of the different volatilities. The utilization of very low pressures, for example, approximately $10^{-2}$ mbar in the last degassing zone enables a complete removal of volatile isotropic components and thereby the increase of the mesophase content up to 100 percent. It is advantageous to perform the process so that the mesophase content of the treated pitch lies between 85 and 100 volume percent. This is possible by aimed adjustment of the process temperatures, pressures as well as the residence time of the pitch in the individual zones or the performance with the continuous forced transportation. The values of the parameters required will depend on the quality of the used pitch and cannot be presented in general appropriate manner. For a predetermined pitch, they can be determined however with low research expenses. In contrast to known processes in which difficulties can occur for example coking, formation of various coarse products, when the mesophase content is increased to 85–100 volume percent, in the inventive process due to shorter residence time and high temperature and due to controllable, fast removal of volatile components, high content of the mesophase is achieved without these disadvantages. The thus produced pitch with 85–100 percent mesophase fraction is very well suitable for a melt spinning and, after preoxidation and carbonization or graphitization, to produce carbon fibers or graphite fibers of high strength and modulus values.

The volatile component removed in the degassing zones, in some cases together with inert gas, can be captured and used again. They can be completely or partially added again to an isotropic pitch, which then as described above is thermally treated to form mesophase.

The homogenization is performed in the respective zones mechanically under the action of shear forces, for example by kneading or stirring elements. In some cases, during the degassing and/or transportation steps, for example during the supply to homogenization zone or in the melting zone, shear forces can be used as well.

The inventive process can be performed preferably in an extruder. At least one homogenization and, at least one degassing zone are provided in the extruder, and the film can be heated prior to reaching of the homogenization zone. For this purpose the pitch is introduced into the extruder, melted in the first zone by heating and shaped by an extruder screw to a film which is forcedly transported by the movable screw preferably in horizontal direction. In the homogenization zone the homogenization can be performed by device parts which are mounted on the housing walls and in some cases are movable. The homogenization can be preformed for example in the form of a kneading treatment. Advantageously the two shaft screw kneader can be utilized as an extruder. The tool screws can have same or different axes of rotation to enable a basic homogenization of the thin film. Suitable screw kneaders are available on the market. Also, it is possible to use other apparatuses which can perform the above-mentioned process steps.

The advantage of the utilization of an extruder is that it allows a wider region of pressure control during the process. For example the pressure in the homogenization zone or zones can be adjusted to different values than the values in the degassing zone or zones. When several homogenization zones are provided, a different pressure can be adjusted in them. The same is true for several degassing zones. Moreover, the pressure and temperature can be adjusted so that a continuous supply of the pitch enriched with mesophase to a melt spinning machine is possible. A continuous subsequent melt spinning process represents an economical approach to advantageous methods for producing of pitch fibers.

It can be advantageous when the inventive process is performed with the use of an added reaction catalyst. The reaction catalysts increase the speed of the formation of mesophase in a chemical manner. Examples of such reaction catalysts are elementary sulphur or Lewis-acids such as borontrifluoride which can be removed during the degassing step. The reaction catalysts can be added either to the pitch or to the inert gas.

In accordance with a preferable embodiment of the present invention, the produced pitch enriched with mesophase is continuously supplied to a melt spinning machine. This can be performed by respective transporting devices, also in form of a forced (positive) transportation. In this way the increase of the mesophase contents and the spinning to fibers are performed in an especially economical manner. In the melt spinning machine which can be of a known type pitch fiber is spun, preferably multi-file fibers with an individual titer in the region of 0.6 to 2 dtex. These fibers are first preoxidized in accordance with known processes, subsequently carbonized and in some cases graphitized. Therefore carbon fibers or graphite fibers can be obtained, which due to their mechanical data are well suitable for different applications for example as reinforcing fibers in synthetic plastics.

The present invention is illustrated hereinbelow with examples. The Examples 1 and 2 are given for processes performed each with one homogenization zone and one degassing zone. All homogenization zones in all cases are closed from the environment in a gas-tight manner and no removal of components of the pitch in the homogenization zone takes place.

EXAMPLE 1

A filtered coal tar pitch which was thermally treated and already contained mesophase was decanted to produce a fraction enriched with mesophase. This fraction has a mesophase contents of 74 volume percent. It serves as an initial material for the inventive process.

The pitch produced as described hereinabove was supplied with a rate 1.68 kg/h to a conventional extruder, namely a two shaft screw kneader ZSK 30 of the company Werner and Pfleiderer. The extruder has a melting zone, transporting elements, a homogenization zone, a degassing zone and again a transporting unit. The transporting elements (screws) transport the pitch during a rotation with 200 revolutions per minute. During the transportation the molten pitch is shaped to a film. In the heating part the temperature amount to approximately 296° C., in the transporting zone between the heating zone and the homogenization zone it amounts to approximately 375° C., in the homogenization zone and in the degassing zone it is approximately 449° C. In the degassing zone nitrogen was supplied, the pressure here was adjusting to approximately 150 mbar. The layer thickness of the pitch film in the degassing zone amounted to approximately 2 mm. After the degassing zone the film was cooled to 400° C. and subsequently removed from the extruder. The produced pitch had a mesophase contents of 89 volume percent.

EXAMPLE 2

The pitch used in Example 1 was treated in accordance with the invention process in the same apparatus as in the Example 1. The following values were changed:

| | |
|---|---|
| Supply rate | 1.0 kg/h |
| Temperature in the melting zone | 251° C. |
| Temperature in the transportation zone | 373° C. |
| Temperature in the homogenization zone | 374° C. |
| Temperature in the degassing zone | 374° C. |
| Pressure in the degassing zone | 940 mbar |

The produced pitch had a mesophase content of 81 volume percent.

EXAMPLE 3

An initial material was a pitch based on coal tar which was thermally treated, hydrated, filtrated and subsequently again thermally treated, and had a mesophase content of 88 volume percent. This pitch was supplied with a supply rate of 0.32 kg/h to an extruder as in the Example 1. The extruder contained a melting zone and then, arranged in triplicate one after the other, transporting elements, a homogenization zone and a degassing zone. After the third degassing zone again a transporting unit was provided. In the melting zone the pitch was melted at 320° C., shaped by the subsequent transporting element before the first homogenization zone to a film. The transporting elements transported the pitch at a rotary speed of 200 revolutions per minute. The layer thickness of the pitch film amounted in all homogenization and degassing zones to approximately 2 mm. The temperature amounted to approximately 320° C. after the second degassing zone, in the third homogenization zone it was approximately 360° C., in the third degassing zone it was approximately 446° C. The process was performed in the three degassing zones with nitrogen as inert gas, the pressure amounting in the first degassing zone to approximately 1,000 mbar, in the second degassing zone to approximately 179 mbar, and in the third degassing zone to approximately 165 mbar. After the third degassing zone, the film was cooled to 330° C. The pitch withdrawn from the extruder had a mesophase contents of 99.9 volume percent.

It will be understood that each of the elements described above, or two or more together, may also find a useful application in other types of processes differing from the types described above.

While the invention has been illustrated and described as embodied in a method of increasing a mesophase content in pitch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A process for increasing the content of mesophase in a pitch, comprising the steps of using a high molecular aromatic fraction based on a material selected from the group consisting of coal tar, crude oil and their mixture in molten form, which aromatic fraction may contain mesophase, thermally treating said aromatic fraction, shaping the fraction continuously mechanically to form a thin film with a layer thickness of between substantially 0.007 and 2 cm, successively mechanically forcedly transporting the film with the use of shear forces to provide a thorough continuous mixing through at least one homogenization zone and one degassing zone, mechanically homogenizing the film in the homogenization zone, removing readily volatile components in the degassing zone, and maintaining the temperature of the film in the homogenization zone and in the degassing zone between 320° C. and 470° C.

2. A process as defined in claim 1, wherein said steps of transporting and homogenizing and removing include transporting the film through several homogenization zones and several degassing zones, performing a mechanical homogenization of the film in the several homogenization zones, and performing removal of readily volatile components in the several degassing zones.

3. A process as defined in claim 1; and further comprising the step of forcedly transporting the film after leaving the degassing zone through at least one further homogenization zone and at least one further degassing zone arranged alternatingly with each other.

4. A process as defined in claim 1; and further comprising the step of forcedly transporting the film after leaving the degassing zone through a plurality of further homogenization zones and a plurality of further degassing zones arranged alternatingly with each other.

5. A process as defined in claim 1, wherein said thermally treating step includes thermally treating in an extruder which has said at least one homogenization zone and at least one degassing zone; and further comprising the step of heating the film prior to reaching the homogenization zone.

6. A process as defined in claim 5, wherein said thermally treating step includes thermal treatment in the extruder formed as a two-shaft screw kneader.

7. A process as defined in claim 1; and further comprising closing the homogenization zone from an environment in a gas-tight manner, and removing no components from the pitch in the homogenization zone.

8. A process as defined in claim 1, wherein said transporting includes forcedly transporting the film in the homogenization zone and in the degassing zone substantially in horizontal direction.

9. A process as defined in claim 1; and further comprising the step of maintaining the layer thickness of the film in the homogenization zone greater than in the degassing zone.

10. A process as defined in claim 1; and further comprising the step of maintaining the layer thickness of the film in the homogenization zone and in the degassing zone in the region of between 0.007 and 0.5 cm.

11. A process as defined in claim 1; and further comprising maintaining the temperature of the film in at least one of said zones in the region of between 370° C. and 470° C.

12. A process as defined in claim 1; and further comprising maintaining the temperature of the film both in said homogenization zone and in said degassing zone in the region of between 370° C. and 470° C.

13. A process as defined in claim 1; and further comprising lowering the temperature of the film after leaving the degassing zone.

14. A process as defined in claim 1; and further comprising the step of maintaining a pressure in the degassing zone in the region of between $10^{-2}$ and 1,200 mbar.

15. A process as defined in claim 1, in which there are several such degassing zones; and further comprising the steps of maintaining a pressure in a first one of said degassing zones in the region of between 100 and 1,200 mbar, and in the remaining one of said degassing zones in the region of between $10^{-2}$ and 100 mbar.

16. A process as defined in claim 1; and further comprising the step of performing a degassing in the degassing zone under inert gas.

17. A process as defined in claim 16, wherein said inert gas is selected from the group consisting of nitrogen and argon.

18. A process as defined in claim 16; and further comprising the step of moving the inert gas in the degassing zone over a surface of the film of the pitch.

19. A process as defined in claim 1; and further comprising the steps of supplying the film after the degassing zone continuously to a melt spinning machine; and spinning the same to form pitch fibers.

20. A process as defined in claim 19, wherein said spinning includes forming multi-file fibers with an individual titer in the region of 0.6–2 dtex.

21. A process as defined in claim 19; and further comprising the steps of preoxidation and carbonization of the fibers after the spinning.

22. A process as defined in claim 21; and further comprising the step of graphitization of the fibers after the carbonization.

23. A process as defined in claim 1; and further comprising the step of selecting the residence time for the film of the pitch in the homogenization zone and in the degassing zone, and the temperature and pressure in said zones so that said mesophase content of the pitch after the degassing zone is between 85 and 100 volume percent.

24. A process as defined in claim 1, wherein the used high molecular aromatic fraction is a pitch produced by filtration and distillation of a material selected from the group consisting of coal tar pitch and crude oil pitch.

25. A process as defined in claim 24, wherein the material is also subjected to a thermal treatment.

26. A process as defined in claim 24, wherein the material is also subjected to an extraction.

27. A process as defined in claim 24; and further comprising performing after the filtration and distillation steps also a mechanical separation of two mutually non-soluble liquid phases in the pitch, further using a mesophase-rich one of the phases and removing a solvent from the same.

28. A process as defined in claim 27; and further comprising filtering the mesophase-rich phase after the mechanical separation.

29. A process as defined in claim 1, wherein the used high molecular aromatic fraction is a pitch which has a mesophase content of between 30 and 90 volume percent.

30. A process as defined in claim 29, wherein the mesophase content of the used pitch lies in the region of between 70 and 90 volume percent.

31. A process as defined in claim 1; and further comprising using an added reaction catalyst.

* * * * *